US008079780B2

(12) United States Patent
Wissmann et al.

(10) Patent No.: US 8,079,780 B2
(45) Date of Patent: Dec. 20, 2011

(54) SLOTTED MANDREL FOR LATERAL DISPLACEMENT PIER AND METHOD OF USE

(75) Inventors: Kord J. Wissmann, Mooresville, NC (US); Gale M. Peterson, Reinbeck, IA (US)

(73) Assignee: Geopier Foundation Company, Inc., Mooresville, NC (US)

( * ) Notice: Subject to any disclaimer, the term of this patent is extended or adjusted under 35 U.S.C. 154(b) by 77 days.

(21) Appl. No.: 11/913,111

(22) PCT Filed: May 19, 2006

(86) PCT No.: PCT/US2006/019678

§ 371 (c)(1), (2), (4) Date: Oct. 30, 2007

(87) PCT Pub. No.: WO2006/127571

PCT Pub. Date: Nov. 30, 2006

(65) Prior Publication Data

US 2008/0193223 A1 Aug. 14, 2008

Related U.S. Application Data

(60) Provisional application No. 60/682,826, filed on May 20, 2005.

(51) Int. Cl.
*E02D 3/08* (2006.01)

(52) U.S. Cl. ..... 405/240

(58) Field of Classification Search ..... 405/231–233, 405/240, 248–249, 255–257, 235
See application file for complete search history.

(56) References Cited

U.S. PATENT DOCUMENTS

| | | | | |
|---|---|---|---|---|
| 3,851,484 | A | 12/1974 | Steding | |
| 4,009,582 | A | 3/1977 | LeCorgne | |
| 4,018,056 | A | 4/1977 | Poma | |
| 2004/0115011 | A1 | 6/2004 | Fox | |
| 2004/0247397 | A1 * | 12/2004 | Fox | 405/248 |

FOREIGN PATENT DOCUMENTS

| | | | |
|---|---|---|---|
| DE | 10163237 | A1 | 7/2003 |
| EP | 1234916 | B1 | 5/2006 |

OTHER PUBLICATIONS

PCT/US06/19678 International Preliminary Report on Patentability dated Feb. 29, 2008.
PCT/US06.19678 International Search Report and Written Opinion dated May 11, 2007.

* cited by examiner

*Primary Examiner* — Sunil Singh
(74) *Attorney, Agent, or Firm* — Ward and Smith, P.A.

(57) ABSTRACT

A slotted mandrel is used in displacement pier construction. Longitudinal slots are formed in the sides of the hollow mandrel which allow for the introduction of aggregate efficiently into the mandrel from a hopper through which the mandrel passes while being driven into the ground. Water may also be employed with the aggregate. Once in the ground the mandrel is raised to release the aggregate (and water if present) into the formed hole in lifts and a mandrel head then compacts the aggregate in the hole. This apparatus and method obviates the need for complicated and expensive hoppers that are raised with the mandrel or the use of expensive aggregate delivery systems.

23 Claims, 8 Drawing Sheets

SLOTTED MANDREL FOR LATERAL DISPLACEMENT PIER AND METHOD OF USE

RELATED APPLICATION

This application is entitled to and hereby claims the priority of U.S. provisional application Ser. No. 60/682,826, filed May 20, 2005.

FIELD OF THE INVENTION

The present invention relates to the installation of aggregate piers in foundation soils for the support of buildings, walls, industrial facilities, and transportation-related structures. In particular the invention is a method and apparatus for the efficient installation of aggregate piers through the use of a slotted mandrel that eliminates the need for an elevated hopper and complicated aggregate delivery system.

BACKGROUND

Heavy or settlement-sensitive facilities that are located in areas containing soft or weak soils are often supported on deep foundations, consisting of driven piles or drilled concrete piers. The deep foundations are designed to transfer the structure loads through the soft soils to more competent soil strata.

In recent years, aggregate piers have been increasingly used to support structures located in areas containing soft soils. The piers are designed to reinforce and strengthen the soft layer and minimize resulting settlements. The piers are constructed using a variety of methods including the drilling and tamping method described in U.S. Pat. Nos. 5,249,892 and 6,354,766 ("short aggregate piers"), the driven mandrel method described in U.S. Pat. No. 6,425,713 ("Lateral Displacement Pier), and the tamper head driven mandrel method known as the "Impact Pier" as disclosed in published U.S. patent application, Pub. No. U.S.2004/0115011, dated Jun. 17, 2004.

The Short Aggregate Pier method (U.S. Pat. Nos. 5,249,892 and 6,354,766), which includes drilling or excavating a cavity, is an effective foundation solution when installed in cohesive soils where the sidewall stability of the hole is easily maintained.

The Lateral Displacement Pier (U.S. Pat. No. 6,425,713) and Impact Pier (U.S. patent application, Pub. No. U.S.2004/0115011) methods were developed for aggregate pier installations in granular soils where the sidewall stability of cavities is not easily maintained. The Lateral Displacement Pier is built by driving a pipe into the ground, drilling out the soil inside the pipe, filling the pipe with aggregate, and using the pipe to compact the aggregate "in thin lifts". A beveled edge is used at the bottom of the pipe for compaction. The Impact Pier covers an extension of the Lateral Displacement Pier. In this case, a smaller diameter (8 to 16 inch) tamper head is driven into the ground. The tamper head is attached to a pipe, which is filled with crushed stone once the tamper head is driven to the design depth. The tamper head is lifted allowing stone to fall into the cavity and then the tamper head is driven back down densifying each lift of aggregate. One advantage of the Impact Pier is the speed of pier construction.

To supply sufficient aggregate for the completion of the pier, the methods for both the Lateral Displacement Pier and the Impact Pier require either that a hopper, located at the top of the pipe or mandrel, be filled and lifted with the pipe or mandrel as part of pier installation activities, or that an aggregate delivery system be implemented to raise aggregate to the top of the pipe or mandrel during installation activities. Both the use of a raised hopper and the use of an aggregate delivery system add complexity and costs to the pier construction process.

SUMMARY OF THE INVENTION

The Slotted Mandrel Lateral Displacement Pier in accordance with the present invention is an improvement over the driven mandrel methods described in U.S. Pat. No. 6,425,713 ("Lateral Displacement Pier), and the tamper head driven mandrel method disclosed in the aforecited published patent application U.S.2004/0115011 ("Impact Pier").

The present invention relies on the use of a slotted mandrel, during the construction of displacement aggregate piers, to allow for the introduction of aggregate into the mandrel at the grade level of the construction site. The slotted mandrel is constructed with a series of longitudinal slots extending through a major length of the mandrel and, preferably, on opposite sides to provide two series or courses of slots along the length of the mandrel.

The mandrel is fitted with a sacrificial plate (disposable driving shoe) inserted into the head of the mandrel, which keeps soil from entering the mandrel during driving and is left at the bottom of the hole during aggregate placement and compaction. Prior to mandrel driving operations, the mandrel is positioned through a hole in the bottom of a stationery hopper and the tip or head of the mandrel rests on the ground surface. The stationery hopper is then filled with aggregate. The mandrel is then driven through the stationery hopper and its hole in the bottom to the mandrel's design depth. As the mandrel passes through the hopper, the aggregate in the hopper enters into the mandrel through the specially-designed slots. The entering aggregate fills the mandrel as it is being driven downwards and prevents the matrix soils from entering into the slots.

Water may be added to the aggregate to increase aggregate flow through the mandrel and to aid in preventing matrix soils from entering the slots. During the subsequent discharge of aggregate out of the bottom of the mandrel during compaction operations, the slotted mandrel is continuously filled with aggregate and water, as necessary, as the aggregate in the hopper passes through the slots. The present invention obviates the need for an expensive hopper that is raised with the mandrel during pier installation or the need for an expensive aggregate delivery system to the top of the mandrel should a raised hopper be considered undesirable. Furthermore, the use of the slotted mandrel with the at-grade hopper allows site engineers to observe the flow of aggregate into the mandrel from the hopper, thus increasing confidence that aggregate is discharged appropriately at the correct depths during the compaction operations.

Accordingly, it is an object of the present invention to provide a method and apparatus for the efficient installation of aggregate piers through the use of a slotted hollow mandrel that eliminates the need for an elevated hopper and/or a complicated aggregate delivery system.

A further object of the present invention is to provide a method and apparatus in accordance with the preceding object in which aggregate can be filled into the slotted mandrel through elongated vertically arranged slots in a side wall of the mandrel.

Another object of the present invention is to provide a method and apparatus in accordance with the preceding objects which includes a hopper at the grade level of the construction site through which the mandrel passes to receive the aggregate as the mandrel is driven into the soil.

A still further object of the present invention is to provide a method and apparatus in accordance with the preceding objects in which the slotted mandrel is fitted with a sacrificial plate inserted into the head of the mandrel. The sacrificial plate keeps soil from entering the mandrel through its open bottom during driving and is left at the bottom of the hole during aggregate placement and compaction.

Still another object of the present invention is to provide a method and apparatus in accordance with the preceding objects which includes the addition of water to the aggregate to increase aggregate flow through the mandrel and to aid in preventing matrix soils from entering the mandrel slots.

Yet a further object of the present invention is to provide a method and apparatus in accordance with the preceding objects which deposits the aggregate into the hole through the open bottom of the mandrel in discrete lifts, and compacts each aggregate lift separately to both compact the aggregate in the hole and displace the aggregate laterally into the sidewalls of the hole.

A final object of the present invention to be specifically identified herein is to provide a method and apparatus for the installation of aggregate piers through the use of a slotted mandrel in accordance with the previous objects which mandrel can be readily constructed of available materials and provides a pier construction method and apparatus that is efficient and cost effective.

These together with other objects and advantages which will become subsequently apparent reside in the details of construction and operation of the invention as more fully hereinafter described and claimed, reference being had to the accompanying drawings forming a part hereof, wherein like numerals refer to like parts throughout. The drawings are intended to illustrate the invention, but are not necessarily to scale.

DETAILED DESCRIPTION OF PREFERRED EMBODIMENT

Figure 1:
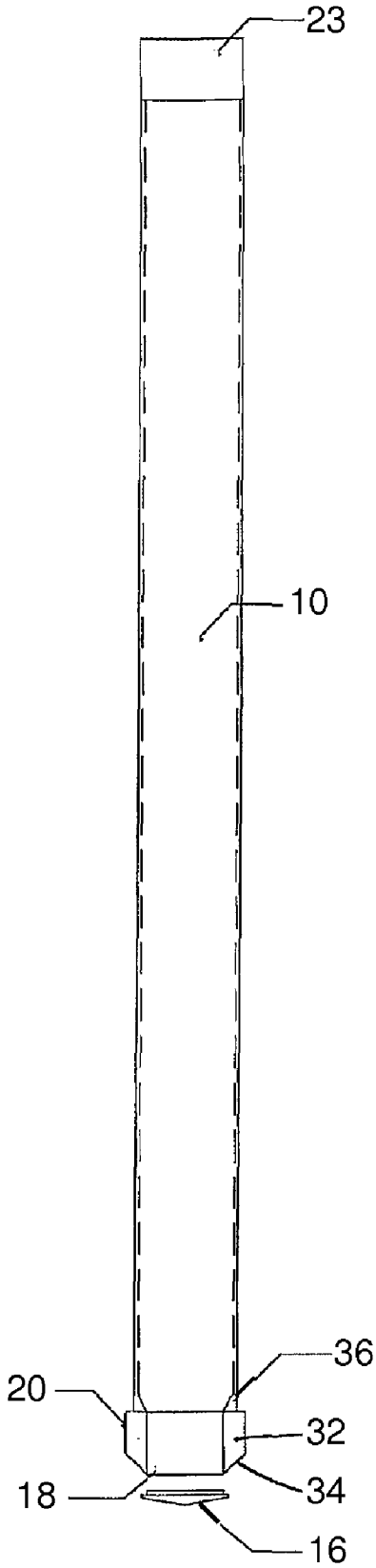
FIG. 1 is a front view of a slotted mandrel in accordance with the present invention.

Before any embodiment of the invention is explained in detail, it is to be understood that the invention is not limited in its application to the details of construction and arrangements of components set forth in the following description or illustrations in the drawings. The invention is capable of alternative embodiments and of being practiced or carried out in various ways. Specifically, the dimensions as described and where they appear on the drawings are exemplary embodiments only and may be modified by those skilled in the art as the conditions warrant.

A method and apparatus is provided for the efficient installation of aggregate piers in foundation soils. The method consists of driving a slotted hollow mandrel, generally designated by reference numeral 10, into the foundation soils with a base machine 12 capable of driving the mandrel. The base machine is typically equipped with a vibratory piling hammer 14 and the ability to apply a downward or crowd force to the mandrel 10 to achieve penetration.

Prior to driving, the mandrel 10 is fitted with a disposable driving shoe 16 which fits into the inside annulus 18 of the mandrel head 20 at the bottom of the mandrel. The disposable driving shoe 16 is slightly larger than the annulus 18 of the mandrel head 20 and thus remains in position at the bottom of the mandrel during driving to the required driving depth. When the mandrel 10 is raised, the driving shoe 16 remains at the driven depth and is sacrificial to the operation. The driving shoe may be fabricated from steel, steel alloys, wood, metal plates, or other suitable construction materials. Alternatively, the bottom of the mandrel may contain a valve that can be closed and opened as the mandrel is driven and lifted.

Figure 4B:
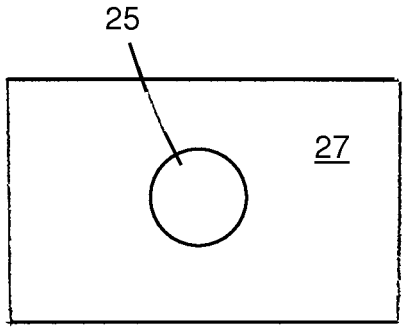
FIG. 4B is a bottom view of the stationary hopper showing the opening through which the mandrel passes during driving of the mandrel into the soil.
Figure 4A:
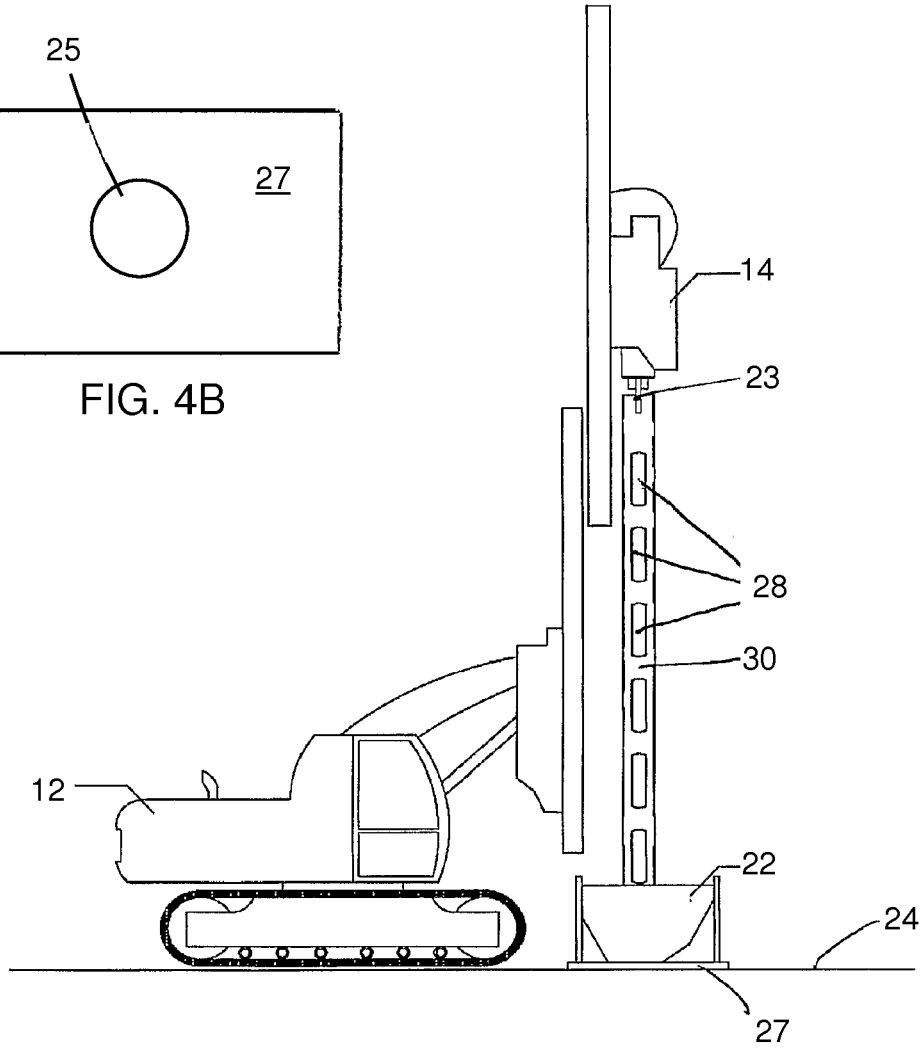
FIG. 4A is a side view of the slotted mandrel of FIGS. 1 and 2 as it extends through a stationery hopper placed at-grade and prior to driving the mandrel.
Figure 5:
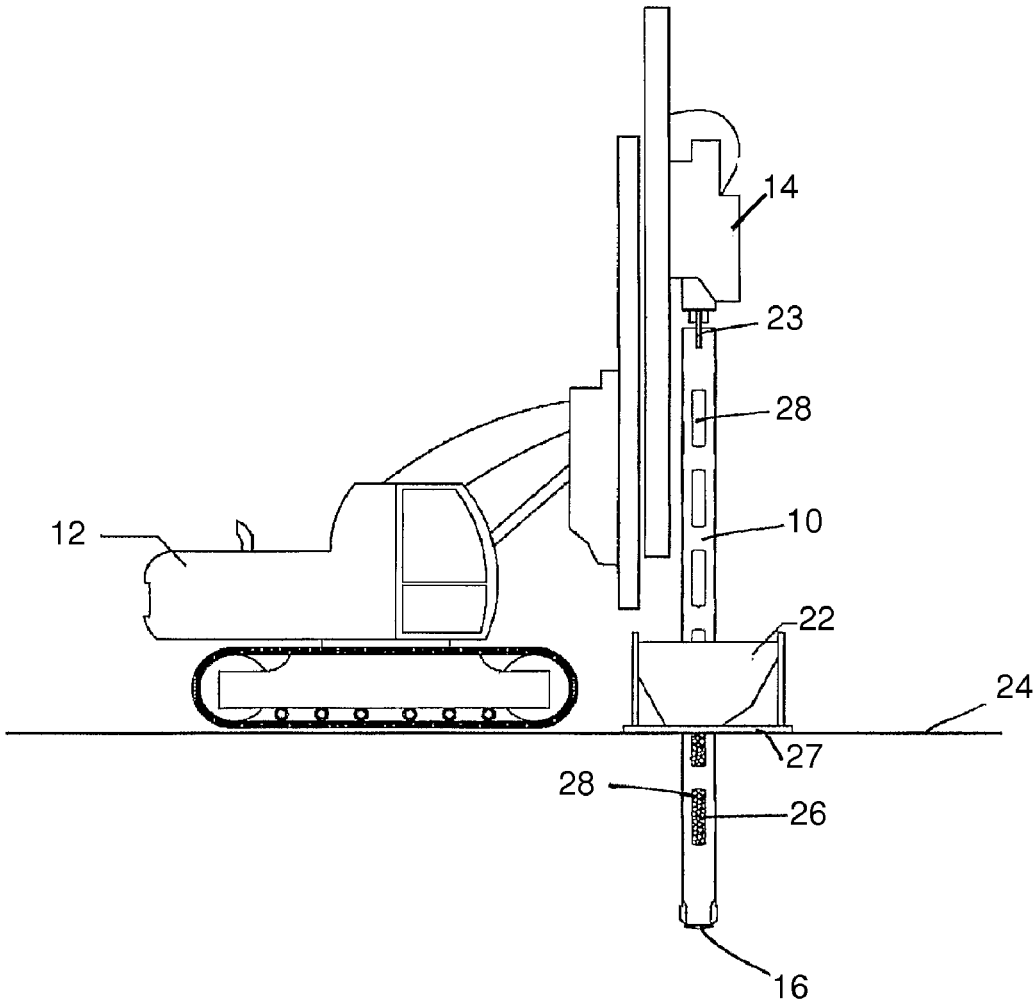
FIG. 5 is a side view of the slotted mandrel of FIGS. 1 and 2 as it is being driven and prior to mandrel extraction.
Figure 6:
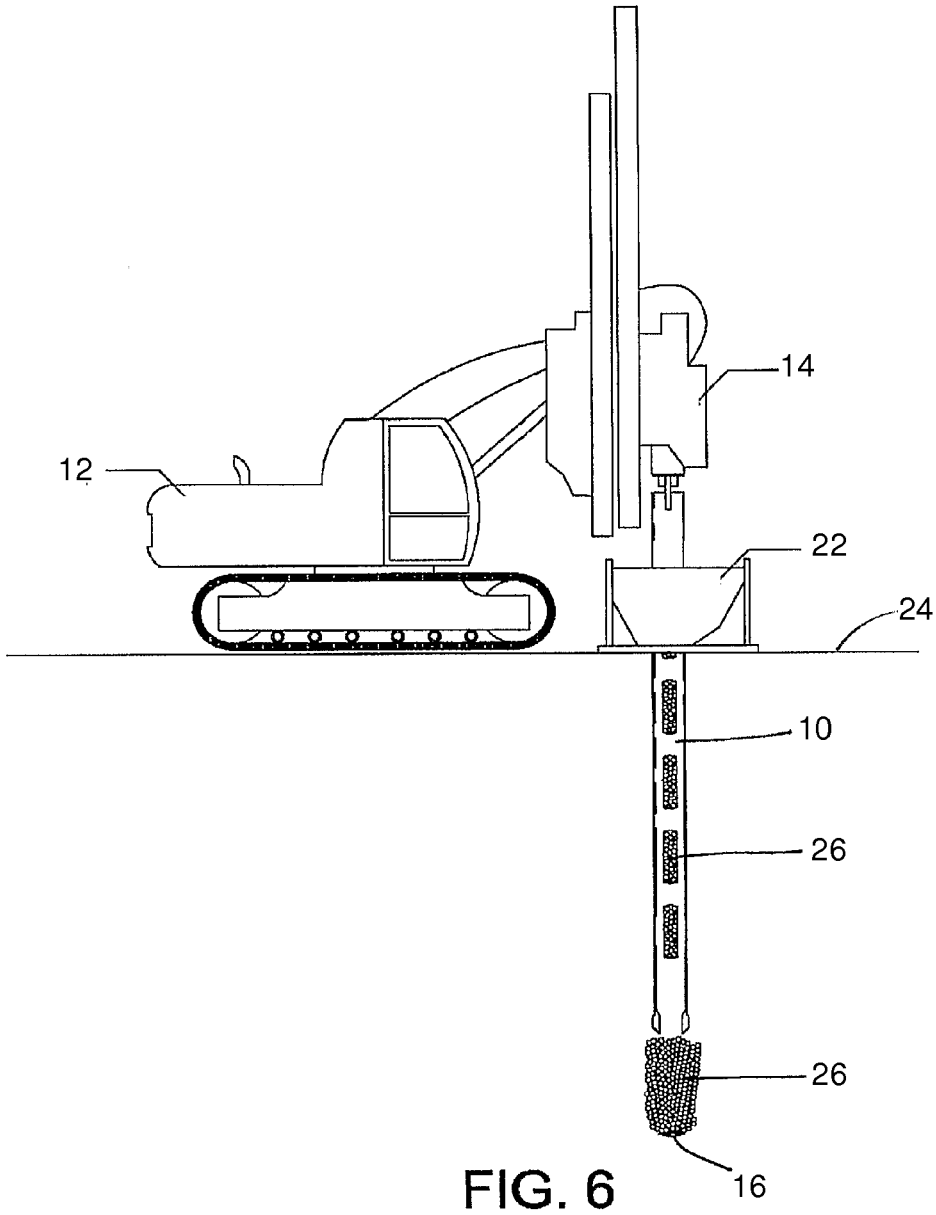
FIG. 6 is a side view of the slotted mandrel of FIGS. 1 and 2 as the mandrel is being extracted and prior to the aggregate being compacted.
Figure 7:
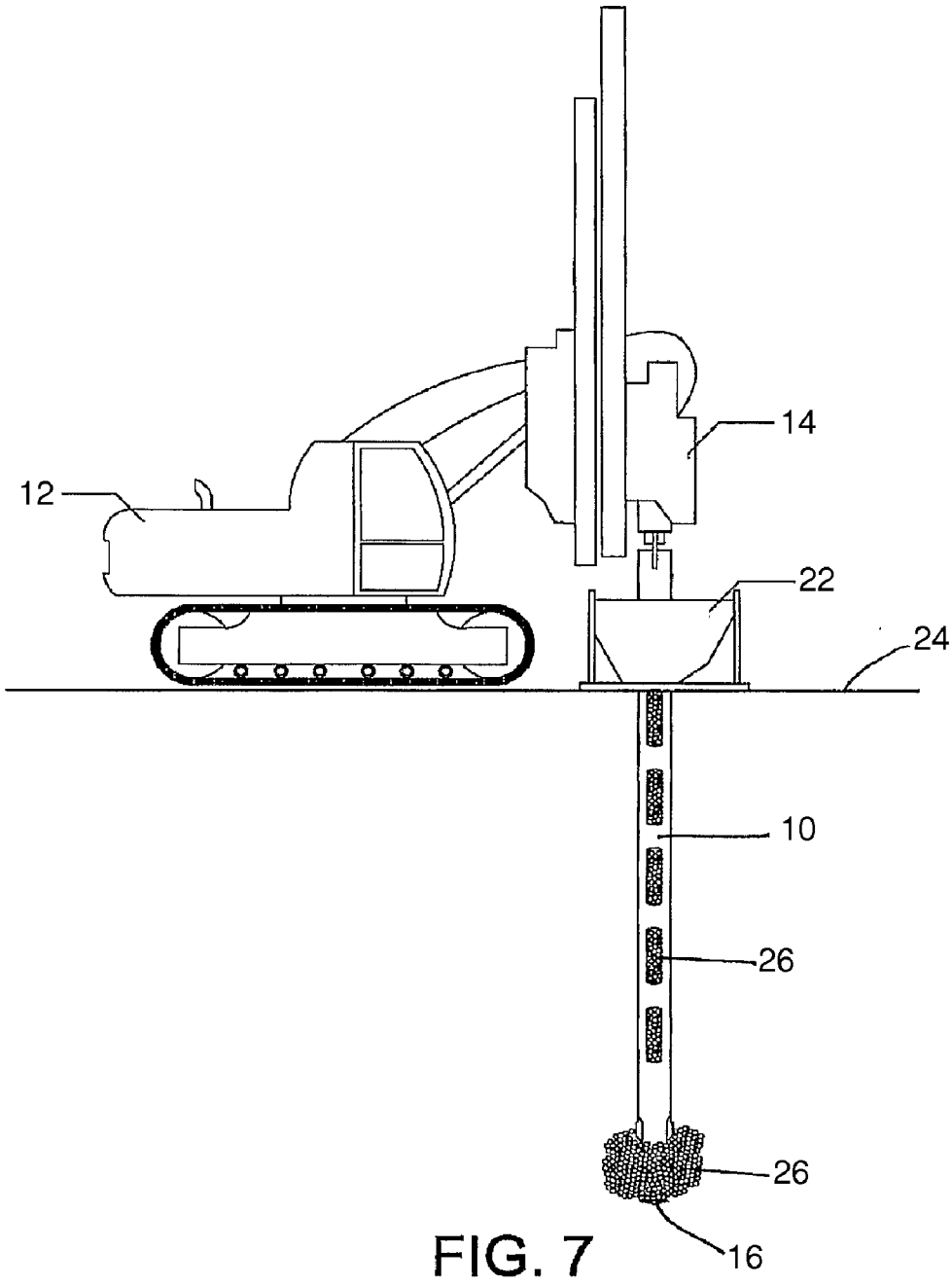
FIG. 7 is a side view of the slotted mandrel of FIGS. 1 and 2 as the aggregate is being compacted.
Figure 8:
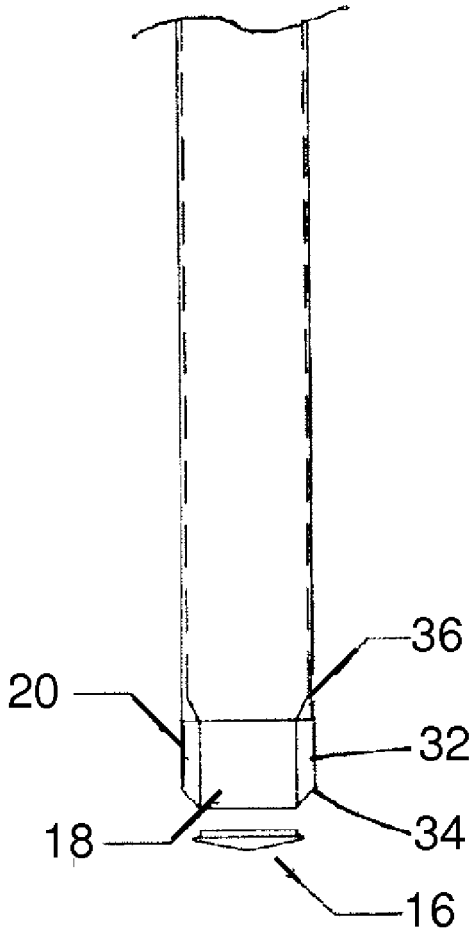
FIG. 8 is a front view of a mandrel head in accordance with an alternative embodiment of the slotted mandrel according to the present invention.

The mandrel is positioned through a hopper 22 that remains stationery at the ground surface 24 during mandrel driving. The hopper 22 is used to feed aggregate 26 to the mandrel 10 during driving. In the present embodiment, the hopper is fitted with a 14-inch diameter hole 25 in its bottom 27 ( see FIG. 4A). Other hole diameters may be used as appropriate with differing mandrel diameters. The hole 25 may be circular or shaped to accommodate the cross-sectional shape of the mandrel. The mandrel 10 passes through the hole 25 during driving to the desired depth.

After the mandrel 10 is placed through the hole 25 in the bottom 27 of the hopper 22, the hopper is filled with aggregate 26. In the presently described embodiment, the aggregate consists of "clean" stone with a maximum particle size of 1.5 inches and less than 5% passing the No. 200 sieve size (0.074 inches). Alternate aggregates may also be used such as clean stone maximum particles sizes ranging between ¼-inch and 3 inches, aggregates with more than 5% passing the No. 200 sieve size, recycled concrete, slag, recycled asphalt, and other construction materials. The maximum size of the aggregate should not exceed 50% of the width of the slots 28 (described hereinafter) in the mandrel 10.

Figure 3:
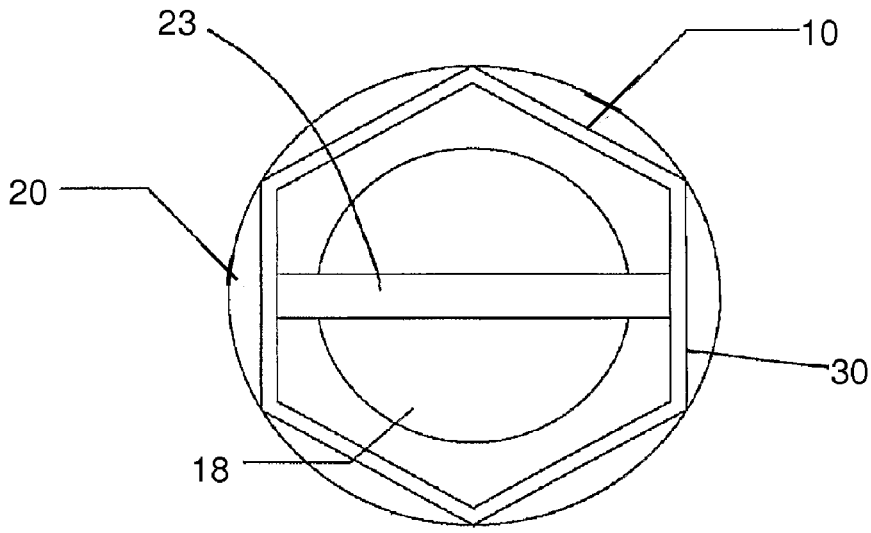
FIG. 3 is a top view of the slotted mandrel of FIGS. 1 and 2.

To facilitate the flow of rock from the stationery hopper 22 into the mandrel 10, elongated slots are cut longitudinally into the sides or body 30 of the mandrel. In the present embodiment, two series or courses of slots 28 are cut, each on an opposite side 30 of the mandrel body 10. The slots 28 are preferably about 6 inches wide and about 24 inches long, and are separated vertically by a distance of about 12 inches. The number of courses and the width and length of the slots may be varied to achieve optimum flow of the rock into the mandrel depending on the cross-sectional size of the mandrel and the size of aggregate being used. However, to maintain structural stability of the mandrel, the sum of the width of slots located at any elevation on the mandrel should not exceed 50% of the perimeter length of the mandrel cross-section at that elevation. The mandrel 10 is constructed using, preferably, ½-inch or ⅜-inch thickness rolled steel that is bent to form a hexagon. This is shown in the top view of the mandrel in FIG. 3. The open mandrel sides are welded together to form a continuous tube. Other mandrel dimensions and shapes may also be used such as mandrels made from steel to form a square, octagonal, or other articulated shape, or a mandrel with circular cross-section. The mandrel wall thickness may vary from ¼-inch to one inch, depending on the mandrel diameter, length, mandrel construction materials, and driving conditions. The mandrel is typically 10 to 40 feet long. However, alternate lengths, as short as 5 feet and as long as 70 feet may be used.

Figure 2:
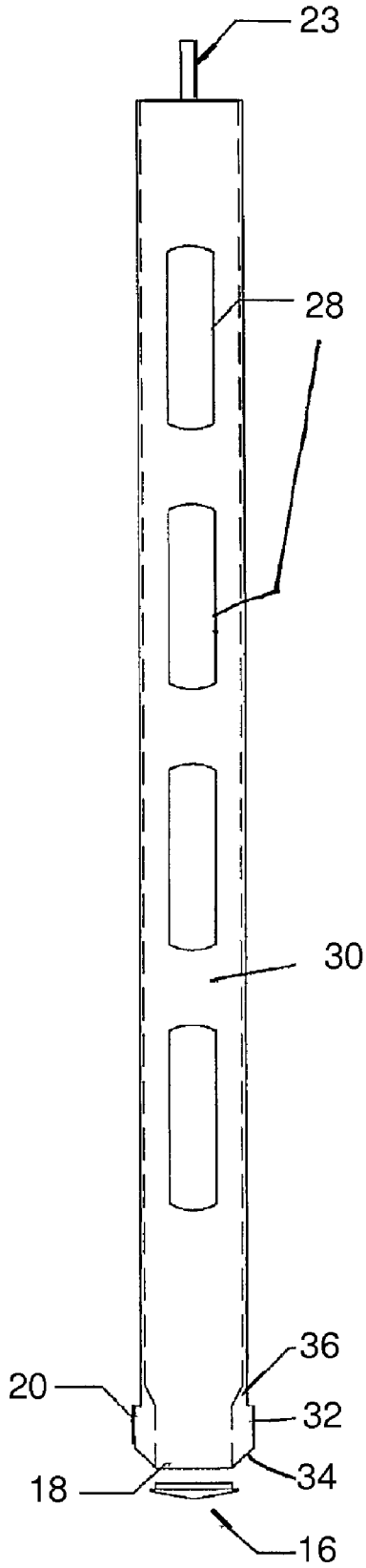
FIG. 2 is a side view of the slotted mandrel of FIG. 1 showing the longitudinal slots according to the present invention.

The mandrel head 20 is preferably in the form of a steel tamper foot 32 welded or bolted at the bottom of the mandrel 10. In the presently described embodiment, the tamper foot 32 is cylindrical and has a maximum diameter of 14-inches. As shown in FIGS. 1 and 2, the tamper foot 32 is approximately 8 inches thick and the sides 34 of the tamper foot are beveled at about a 45-degree angle. This shape pushes the aggregate out laterally during compaction operations. The tamper foot 32 is also hollow. In the presently described embodiment, the diameter of the annular space 18 within the hollow tamper foot is about 10 inches. Because the inside of the hexagonal mandrel 10 is slightly larger than the annular space 18 of the tamper foot, steel flanges 36 are welded to the inside of the mandrel 10 to facilitate smooth flow of aggregate through the mandrel and out through the tamper foot. Other mandrel foot diameters, thicknesses, and annular space dimensions may also be used. The mandrel foot 32 may range in diameter from 6 inches to 24 inches depending on driving conditions. The mandrel foot may also vary in thickness from one inch to 10 inches. The annular space 18 may vary in diameter from 4 inches to 23.5 inches depending on the diameter of the mandrel foot. The maximum cross-sectional dimension of the mandrel should be the same size or less than the maximum size of the mandrel foot.

The mandrel 10 is placed through the hopper 22 prior to filling the hopper with aggregate. The hopper 22 is filled with aggregate 26 prior to driving the mandrel 10. The mandrel is then driven through the hopper 22 to the design depth using the vibratory piling hammer 14 connected to the drive and support plate 23 welded or otherwise attached at the top of the mandrel 10. During the driving, the aggregate 26 flows from the hopper 22 and through the slots 28 in the side of the mandrel to fill the mandrel. Because the aggregate fills the inside of the mandrel, the surrounding soils cannot squeeze through the slots into the mandrel during driving.

To facilitate aggregate flow and to aid in the prevention of migration of the matrix soil into the slots 28, water may be added to the aggregate during driving and pier building. Water may be added through water jets in the mandrel or by filling the hopper 22 with water after filling the hopper with aggregate 26.

Once the mandrel reaches the design depth and the mandrel is raised slightly, the sacrificial shoe 16 becomes dislodged and remains at the design depth. As the mandrel is raised, the aggregate 26 flows out the annular space 18 in the tamper foot 32. The mandrel 10 is raised, typically about 3 feet, and then re-driven back down to compact the aggregate 26 that has flowed out of the mandrel head 20 (or tamper foot 32). Other raising and redriving dimensions may be used. For example, to achieve a wider aggregate pier, the mandrel may be raised 4 or 5 feet and then redriven 3 or 4 feet providing for a greater compacted width of aggregate at a given depth. For applications where smaller widths are desired, the mandrel may be raised 2 feet and redriven 1 foot.

The beveled sides 34 of the mandrel head 20 facilitate pushing the aggregate laterally into the sidewalls of the hole and increase the pressure in the surrounding soils. In the presently described embodiment, the bevels are tapered at an inclination of about 45 degrees from horizontal. However, other bevel angles may be used, such as 30 degrees or 60 degrees from horizontal. The steeper the bevel angle from horizontal, the greater the penetration of the aggregate into the surrounding soil mass.

The pier is built incrementally from the bottom up. Because the slots 28 extend nearly the full length of the mandrel, the mandrel can be constantly filled from the hopper with aggregate flowing through the slots.

The foregoing is considered as illustrative only of the principals of the invention. Further, since numerous modifications and changes may readily occur to those skilled in the art, it is not desired to limit the invention to the exact construction and operation described and shown. Rather, all suitable modifications and equivalents may be resorted to that fall within the scope of the invention.

What is claimed is:

1. A system for constructing aggregate piers, the system comprising:

a hollow mandrel having an open internal diameter and having elongated slots spaced vertically in a sidewall of said mandrel, said elongated slots comprising two series of said elongated slots each slot having a minimum width at least twice the maximum diameter of aggregate to be used with the system, each series spaced vertically and continuously on opposite sidewalls along the length of said mandrel from a proximal end to a distal end, the sum of the width of slots located at any elevation on the mandrel being less than 50% of the perimeter length of the mandrel cross-section at that elevation and a centerline horizontally spaced between the two opposing series of slots comprising vertically continuous sidewall material from the proximal end to the distal end, said slots adapted to allow for the continual flow of the aggregate therein, and said mandrel having a width substantially the same width as a cavity being formed, the aggregate filling the interior of the mandrel and preventing soils from entering the mandrel due to the aggregate in the mandrel;

a mandrel head connected to the distal end of the mandrel and configured for compacting the aggregate after discharge of the aggregate from the distal end of said mandrel, and said mandrel head being shaped like a tamper foot and attached to said mandrel, and having a beveled surface at bottom sides thereof;

a base machine operatively connected to the proximal end for driving said mandrel generally vertically into the ground; and a hopper at the ground surface through which said mandrel passes, said hopper filled with the aggregate to flow into said mandrel through said series of elongated slots.

2. The system of claim 1, wherein the mandrel has a cylindrical shape.

3. The system of claim 1, wherein the mandrel has an articulated shape, comprising a hexagonal or an octagonal cross-section.

4. The system of claim 1, wherein the mandrel includes a mandrel shaft and said mandrel head is larger in outside diameter than said mandrel shaft.

5. The system of claim 1, wherein the mandrel includes a mandrel shaft and said mandrel head has an outside diameter the same as the mandrel shaft.

6. The system of claim 1, wherein the mandrel head is cylindrical.

7. The system of claim 1, wherein the aggregate is selected from the group consisting of stone, fine materials, recycled concrete, recycled asphalt, slag, or other construction materials.

8. The system of claim 1, further comprising a sacrificial plate positioned in the bottom of said mandrel.

9. The system of claim 1, wherein water is added to the aggregate.

10. The system of claim 1, further comprising a valve positioned in the bottom of said mandrel to alternately retain said aggregate in said mandrel and release said aggregate from a bottom of said mandrel.

11. The system of claim 1, wherein the tamper foot of the mandrel head has an internal diameter smaller than the mandrel internal diameter, the mandrel head further comprising a reducing surface for reducing the mandrel internal diameter to the tamper foot internal diameter.

12. The system of claim 11, wherein the reducing surface comprises steel flanges.

13. An apparatus for constructing aggregate piers, the apparatus comprising:

a hollow mandrel having an open internal diameter and having elongated vertical slots spaced longitudinally therein and a sacrificial driving shoe positioned at the bottom thereof, said elongated slots comprising two series of said elongated slots each slot having a minimum width at least twice the maximum diameter of aggregate to be used with the system, each series spaced continuously vertically on opposite sidewalls along the length of said mandrel from a proximal end to a distal end, the sum of the width of slots located at any elevation on the mandrel being less than 50% of the perimeter length of the mandrel cross-section at that elevation and a centerline horizontally spaced between the two opposing series of slots comprising vertically continuous sidewall material from the proximal end to the distal end, said slots adapted to allow for the continual flow of the aggregate therein, and said mandrel having a width substantially the same width as a cavity being formed, the aggregate filling the interior of the mandrel and preventing soils from entering the mandrel due to the aggregate in the mandrel;

a mandrel head connected to the distal end of the mandrel and adapted for compacting the aggregate, said mandrel head being shaped like a tamper foot and attached to said mandrel, and having a beveled surface at bottom sides thereof;

a base machine operatively connected to the proximal end for driving the mandrel and driving shoe vertically to a depth in the ground; and a hopper having a hole through which said mandrel is driven and filled with the aggregate prior to driving of the mandrel to cause the aggregate to flow into said mandrel through said series of elongated slots.

14. The apparatus of claim 13, wherein said slots have a width which is no more than fifty percent (50%) of the peripheral length at any cross-sectional elevation of said mandrel.

15. The apparatus of claim 13, wherein said slots are sized to permit the aggregate to flow freely from outside said mandrel to inside said mandrel.

16. The apparatus of claim 13, wherein the tamper foot of the mandrel head has an internal diameter smaller than the mandrel internal diameter, the mandrel head further comprising a reducing surface for reducing the mandrel internal diameter to the tamper foot internal diameter.

17. The apparatus of claim 16, wherein the reducing surface comprises steel flanges.

18. A method for constructing an aggregate pier in ground soils where sidewall stability of a vertical cavity is difficult to maintain, the method comprising:

positioning a slotted mandrel vertically in a hole of a hopper placed at ground level, the mandrel having an open internal diameter and having slots which are elongated slots spaced continuously vertically in a sidewall of said mandrel and comprising two series of said elongated slots, each series on opposite sidewalls along the length of said slotted mandrel from a proximal end to a distal end, the sum of the width of slots located at any elevation on the mandrel being less than 50% of the perimeter length of the mandrel cross-section at that elevation and a centerline horizontally spaced between the two opposing series of slots comprising vertically continuous sidewall material from the proximal end to the distal end, each slot having a minimum width at least twice the maximum diameter of aggregate to be used with the system, and adapted to allow for the continual flow of the aggregate therein, and said mandrel having a width substantially the same width as the cavity, the aggregate filling the interior of the mandrel and preventing soils from entering the mandrel due to the aggregate in the mandrel;

filling said hopper with the aggregate;

driving said slotted mandrel through said hopper and said hole while the aggregate flows into the mandrel through slots of the mandrel during said driving;

driving said mandrel to form a hole to a desired vertical depth in the ground while continuously filling said mandrel with the aggregate through said slots during forming of said hole to ensure the mandrel is filled with the aggregate at portions thereof in the hole to prevent surrounding soil from entering the mandrel through said slots as said mandrel is driven into the ground;

lifting said mandrel in said hole to allow the aggregate to flow out at a head of the mandrel;

driving said mandrel downwardly to compact the aggregate which flowed out of said mandrel head into the hole, the compaction being accomplished through the mandrel head connected to the distal end of the mandrel, the mandrel head being shaped like a tamper foot and having a beveled surface at bottom sides thereof; and repeating said lifting and driving to achieve compacting until an aggregate pier is formed in said hole.

19. The method of claim 18, wherein the lifting of said mandrel in said hole is only a short distance to allow a lift of the aggregate to flow out into said hole and the driving of said mandrel downwardly compacts the lift of aggregate, and the aforesaid steps are repeated for each aggregate lift as the mandrel moves upwardly in the hole until said aggregate pier is formed.

20. The method of claim 18, wherein said driving of the mandrel downwardly to compact the aggregate causes the aggregate to push laterally into the sidewalls of the hole and increase the pressure in the surrounding soils.

21. The method of claim 18, wherein water is added to the aggregate.

22. The method of claim 18, wherein tamper foot of the mandrel head has an internal diameter smaller than the mandrel internal diameter and wherein a reducing surface for reducing the mandrel internal diameter to the tamper foot internal diameter is positioned to facilitate smooth flow of the aggregate out of the head of the mandrel.

23. The method of claim 22, wherein the reducing surface comprises steel flanges.

* * * * *